US008759697B2

(12) United States Patent
Polston et al.

(10) Patent No.: US 8,759,697 B2
(45) Date of Patent: Jun. 24, 2014

(54) MOLDED CASE CIRCUIT BREAKER CAPABLE OF WITHSTANDING SHORT CIRCUIT CONDITIONS

(75) Inventors: Larry D. Polston, Nicholasville, KY (US); Ivan D. Chavez, Mexico City (MX)

(73) Assignee: Schneider Electric USA, Inc., Palatine, IL (US)

( * ) Notice: Subject to any disclaimer, the term of this patent is extended or adjusted under 35 U.S.C. 154(b) by 257 days.

(21) Appl. No.: 13/271,351

(22) Filed: Oct. 12, 2011

(65) Prior Publication Data

US 2013/0092515 A1 Apr. 18, 2013

(51) Int. Cl.
*H01H 21/04* (2006.01)

(52) U.S. Cl.
USPC ..... 200/303; 200/293

(58) Field of Classification Search
USPC ..... 200/303, 293, 296
See application file for complete search history.

(56) References Cited

U.S. PATENT DOCUMENTS

| | | | | | |
|---|---|---|---|---|---|
| 2,887,525 | A | * | 5/1959 | Lewus | 174/520 |
| 3,048,685 | A | | 8/1962 | Mrenna et al. | |
| 3,356,819 | A | * | 12/1967 | Zavertnik et al. | 200/330 |
| 4,724,513 | A | | 2/1988 | M'Sadoques et al. | |
| 4,975,667 | A | | 12/1990 | Morgan et al. | |
| 5,150,091 | A | * | 9/1992 | Hart et al. | 335/202 |
| 5,323,130 | A | | 6/1994 | Arnold | |
| 5,338,255 | A | * | 8/1994 | Akehurst | 454/292 |
| 5,410,446 | A | | 4/1995 | Wright et al. | |
| 5,595,316 | A | * | 1/1997 | Gallarelli et al. | 220/4.33 |
| 5,744,768 | A | | 4/1998 | Bishop et al. | |
| 5,768,091 | A | | 6/1998 | Vinson et al. | |
| 6,061,230 | A | | 5/2000 | Mazzella et al. | |
| 6,930,577 | B2 | * | 8/2005 | Subramanian et al. | 335/202 |

OTHER PUBLICATIONS

International Search Report mailed Jan. 30, 2013 which issued in corresponding International Patent Application No. PCT/US2012/058529 (4 pages).

Written Opinion mailed Jan. 30, 2013 which issued in corresponding International Patent Application No. PCT/US2012/058529 (7 pages).

* cited by examiner

*Primary Examiner* — Xuong Chung Trans
(74) *Attorney, Agent, or Firm* — Locke Lord LLP

(57) ABSTRACT

A molded case circuit breaker includes a molded case containing a circuit breaker trip unit, and multiple line connector lugs attached to an end portion of the molded case for connecting the trip unit to power cables from a power source. Rigid support brackets attached to a rigid supporting surface extend along a pair of opposite outer side walls of the molded case adjacent the lugs to resist outward movement of the side walls in the event of a short circuit condition that exerts distorting forces on the lugs and the portions of the molded case adjacent the lugs. The rigid support brackets may be attached to a supporting pan attached to the portion of the molded case adjacent the lugs.

9 Claims, 2 Drawing Sheets

MOLDED CASE CIRCUIT BREAKER CAPABLE OF WITHSTANDING SHORT CIRCUIT CONDITIONS

FIELD OF THE INVENTION

The present invention relates generally to molded case circuit breakers and, more particularly, molded case circuit breakers capable of withstanding short circuit conditions.

BACKGROUND OF THE INVENTION

Molded case circuit breakers are commonly used in multi-metering panelboards for commercial and industrial applications that require hundreds, sometimes even thousands, of amperes of current to pass through the circuit breakers. In a short circuit condition, these current levels produce significant magnetic forces on the conductors. Substantially rigid busbars are typically used to connect the load side of the breaker to the load lines, but the line side of the breaker is typically equipped with lugs that can be connected to flexible cables leading to the power distribution lines. The magnetic forces produced by a short circuit is condition can cause whipping of the cables, which exerts significant forces on the lugs and the adjacent portions of the molded case. These forces can pull the cables out of the lugs, displace the lugs, and even cause cracking of the molded case. The cable whipping tends to become more severe as the length of the unsecured cables increases.

One way to reduce the movement of the cables during short circuit events is to "brace" the cables by tying all of the cables together with rope. This practice of "bracing" the cables is common on switchboards with high short circuit current ratings. (See UL 891 paragraphs 6.3.3, 9.2.4.2.4.1, G5.1 and Figure G5.1.) Bracing is primarily intended to prevent the cables from coming out of the lugs, but also reduces movement of the lugs and thus reduces the risk of fracturing the molded case of the circuit breaker. However, the use of cable "bracing" is not always appealing to the customers responsible for implementing it. It is also possible to design reinforcements into the molded case of the circuit breaker, but this increases the cost of the breaker, for a problem that is encountered in only a small percentage of the applications for such breakers. Thus, there is an ongoing need for improved techniques for protecting molded case circuit breakers from the effects of short circuit conditions.

SUMMARY OF THE INVENTION

Rather than using cable bracing or building reinforcement into the molded case, it has been found that external supports can effectively prevent fracturing of the molded case during short circuit conditions. By locating such supports adjacent the side walls of the molded case at opposite ends of the lug shroud, those side walls of the molded case are externally reinforced to resist forces that arise from short circuit conditions that tend to distort the walls of the lug shroud. The end walls of the shroud can move only a fraction of an inch before engaging the rigid brackets, and in certain embodiments the brackets also prevent flexing of the legs of the "pan" typically used to support a molded case circuit breaker. Holding the pan legs rigid holds the flat support plate of the pan firmly in place against the outer surface of the lug-carrying wall of the molded case. The overall effect is to externally reinforce the entire end portion of the molded case that is attached to the line cables, so that the forces applied to that portion of the molded case during a short circuit condition do not fracture the molded case.

The use of external supports permits any given molded case circuit breaker to is be installed with or without reinforcement for short circuit conditions, i.e., the reinforcement is optional and can thus be selectively used only in those applications in which the extra cost is warranted by the risk of short circuit conditions occurring. Thus, the same molded case may be used in all applications, thus reducing manufacturing costs by avoiding the need for different versions of molded cases.

In accordance with one embodiment, a molded case circuit breaker having multiple line connector lugs attached to an end portion of the molded case for connecting the trip unit to lines from a power source, is protected against fracturing during short circuit conditions by a pair of rigid support brackets attached to a rigid supporting structure and extending along a pair of opposite outer side walls of the molded case adjacent the lugs to resist outward movement of the side walls in the event of a short circuit condition that exerts distorting forces on the lugs and the portions of the molded case adjacent the lugs.

In one implementation, each of the support brackets is slightly spaced away from the adjacent surface of one of the opposite sides of the molded case, and an electrical insulator is provided between the support brackets and the adjacent surfaces of the opposite sides of the molded case. When the molded case is a "split" case that is molded in two parts, the brackets may be located entirely on one side, e.g., the lower side, of the split in the area where the lugs are located.

The foregoing and additional aspects of the present invention will be apparent to those of ordinary skill in the art in view of the detailed description of various embodiments, which is made with reference to the drawings, a brief description of which is provided next.

BRIEF DESCRIPTION OF THE DRAWINGS

The invention may best be understood by reference to the following description taken in conjunction with the accompanying drawing, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to cover all alternatives, modifications, and equivalent arrangements as may be included within the spirit and scope of the invention as defined by the appended claims.

Figure 1:
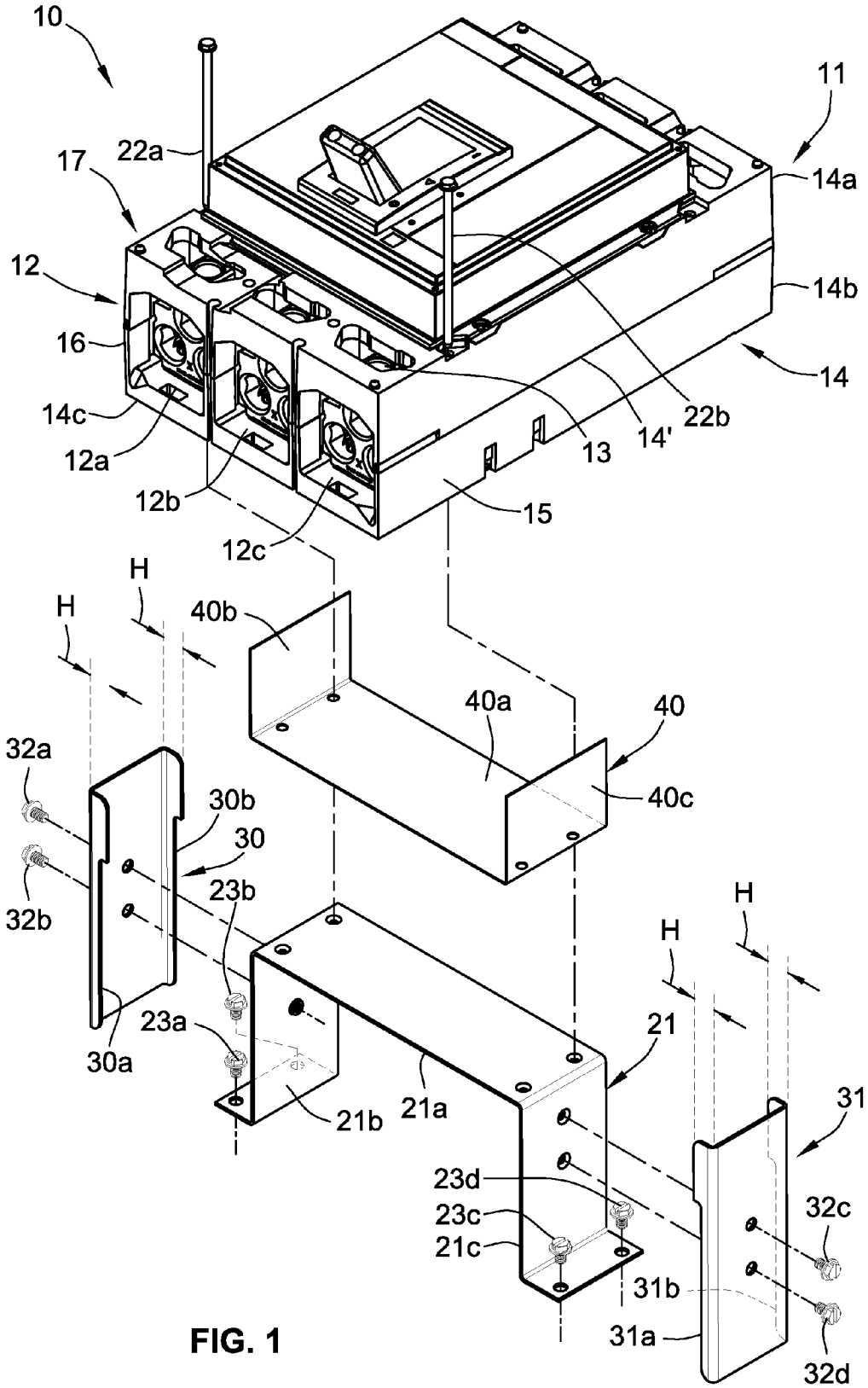
FIG. 1 is a partially exploded perspective view of a molded case circuit breaker with external supports for resisting fracturing of the molded case during short circuit conditions
Figure 2:
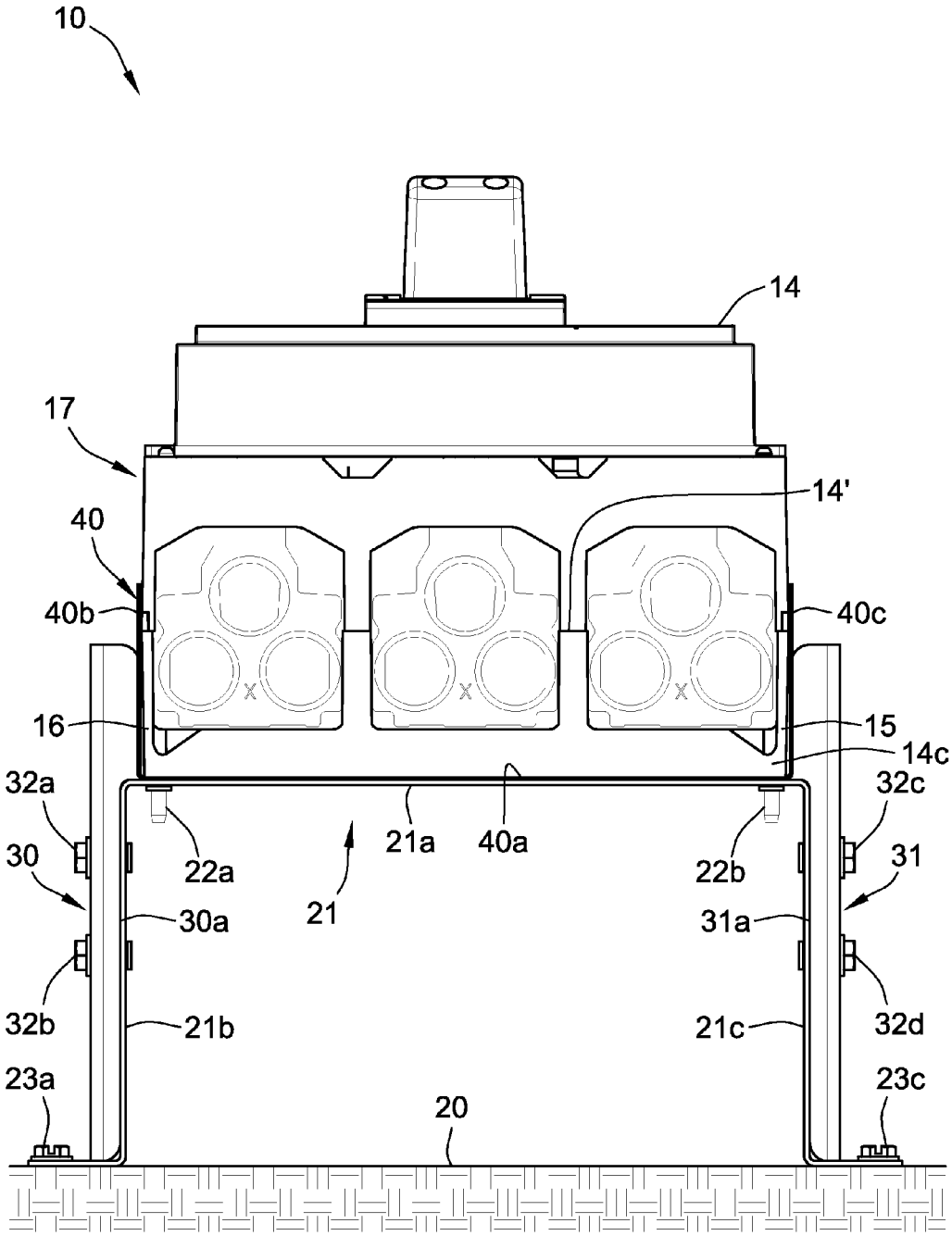
FIG. 2 is an enlarged end elevation of the molded case circuit breaker and supports shown in FIG. 1.

Turning now to the drawings, FIGS. 1 and 2 illustrate a molded case circuit breaker 10 having a load end 11 with a set of terminals that are typically connected to the desired load lines via bus bars. The line end 12 of the breaker 10 includes a set of line connector lugs 12*a*, 12*b* and 12*c* for receiving power cables leading to a power distribution system. In the illustrated embodiment, each of the line connector lugs 12*a*-12*c* forms three holes for receiving three power cables, but the molded case circuit breaker may accept alternate lugs with different sizes and quantities of terminations. Each hole has an associated screw 13 that can be tightened against the cable inserted into that hole, to securely fasten each cable to its corresponding lug 12. The lugs 12*a*-12*c* are in turn electrically connected to a conventional trip unit (not shown) inside the molded case of the breaker 10.

The particular breaker illustrated in FIGS. 1 and 2 has a molded case 14 that is "split" along a line 14' into two parts 14*a* and 14*b*, which means that these two parts are molded separately and then joined together to form a single molded case. As can be seen in FIG. 2, the side walls of each part 14*a* and 14*b* are slightly tapered, to facilitate removal of that part from the mold in which it is formed.

The circuit breaker 10 is installed on a rigid supporting surface 20 (see FIG. 2), which is typically part of a conventional enclosure for the breaker. Secured to the wall 20 is a conventional "pan" 21 that supports the breaker 10 in the desired position within the enclosure, spaced away from the rigid enclosure wall 20. In the illustrative example shown in FIGS. 1 and 2, the pan 21 is generally C-shaped with the closed end portion 21*a* of the C secured to the rear surface of the breaker 10 and the two legs 21*b* and 21*c* of the C secured to the enclosure wall 20. Specifically, the closed end portion 21*a* of the pan engages the rear surface of that portion of the case 14 that surrounds the lugs 12, which is often referred to as the "lug shroud" 17 of the molded case. This is the portion of the molded case that is subjected to the most stress during a is short circuit condition.

In the illustrative embodiment, two screws 22*a* and 22*b* are used to secure the closed end portion 21*a* to the molded case 14, and four screws 23*a*-23*d* are used to secure the legs 21*b* and 21*c* of the pan to the rigid wall 20 of the enclosure. It will be understood, however, that other fastening means such as weldments or rivets could be used in place of the screws.

As can be seen in FIG. 2, two brackets 30 and 31 are rigidly attached to the two pan legs 21*b* and 21*c*, respectively, by screws 32*a*-32*d*. Each bracket 30 and 31 is in the form of a U-shaped channel for rigidity, with the open end of the U facing the pan legs 21*b* and 21*c*. The brackets 30 and 31 extend upwardly beyond the upper ends of their respective pan legs 21*b* and 21*c* so that the upper portions of the brackets 30 and 31 extend along the side walls 15 and 16 of the lug shroud 17. Above the closed end portion 21*a* of the pan, the height H of the side flanges 30*a*, 30*b* and 31*a*, 31*b* of the respective brackets 30 and 31 increases so that the longitudinal edges of those portions of the brackets are located very close, e.g., within 0.010 inch plus the thickness of the insulator, to the shroud side walls 15 and 16 of the molded case 14. Thus, a slight deflection of either side wall 15 or 16 brings it into contact with the adjacent bracket 30 or 31, which then resists any further deflection of that side wall to prevent fractioning of the molded case.

Any forces exerted on the brackets 30 and 31 by the side walls 15 and 16 of the lug shroud 17 are transmitted to the respective pan legs 21*b* and 21*c*, which causes the closed end portion 21*a* of the pan to be urged against the bottom surface 14*c* of the lug shroud 17. In fact, the closed end portion 21*a* of the pan is placed in tension, which further increases the resistance to distortion of the lug-bearing bottom wall 14*c* of the molded case 14. Thus, the lug shroud 17 is externally reinforced on the bottom wall 14*c*, as well as the two side walls 15 and 16, of the lug shroud 17, which are all the exterior walls of the lug shroud 17 formed by the lower section 14*b* of the molded case 14, i.e., the section beneath the split 14' in the molded case. This external reinforcement has been found to be effective in preventing fracturing of the molded case when subjected to short circuit conditions.

To ensure that the pan 21 and the brackets 30 and 31 are all electrically isolated from the molded case 14 and its lugs 12, a sheet 40 of electrically insulating material is is sandwiched between each of the brackets 30 and 31 and the respective side walls 15 and 16 of the lug shroud 17, as at 40*b* and 40*c*, and also between the bottom wall 14*c* of the shroud 17 and the closed end portion 21*a* of the supporting pan 21, as at 40*a*. This electrical insulation may be formed by a single sheet of insulating material that extends across the bottom wall 14*c* of the lug shroud 17 and is folded up at both sides 15 and 16 of the breaker 10 to extend along the side walls 15 and 16 of the shroud 17.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

The invention claimed is:

1. A molded case circuit breaker comprising a molded case containing a circuit breaker trip unit;

multiple line connector lugs attached to an end portion of the molded case and surrounded by a lug shroud portion of the molded case, the multiple line connector lugs configured to connect the trip unit to lines from a power source;

a pan configured to support said molded case on a rigid supporting surface, said pan being generally C-shaped with a closed end portion secured to a rear surface of said lug shroud portion of said molded case and with first and second legs of said C-shaped pan, attached to said rigid supporting surface;

first and second rigid support brackets respectively, rigidly attached to said first and second legs of said C-shaped pan and extending along respective first and second opposite outer side walls of said lug shroud portion of said molded case, said first and second rigid support brackets being configured to resist outward movement of said side walls, the first and second rigid support brackets being further configured to transmit forces exerted on said first and second brackets by said side walls, to said respective first and second legs of said C-shaped pan, placing in tension said closed end portion of said C-shaped pan; and said closed end portion of said C-shaped pan being further configured to resist outward movement of said rear surface of said lug shroud portion of said molded case, when said closed end portion of said C-shaped pan is placed in said tension.

2. The molded case circuit breaker of claim 1 in which each of said support brackets is slightly spaced away from the adjacent surface of one of said opposite sides of said molded case.

3. The molded case circuit breaker of claim 1 which includes an electrical insulator between each of said support brackets and the adjacent surface of one of said opposite sides of said molded case.

4. The molded case circuit breaker of claim 1 in which said molded case is a split case, and each of said brackets is located entirely on one side of said split at an area where said lugs are located.

5. A molded case circuit breaker installation comprising:

a molded case containing a circuit breaker trip unit for interrupting an electrical power circuit in response to predetermined fault conditions including short circuit conditions, a rigid supporting surface for said molded case;

multiple line connector lugs attached to an end portion of the molded case and surrounded by a lug shroud portion of the molded case, the multiple line connector lugs configured to connect the trip unit to multiple electrical power conductor;

a pan configured to support said molded case on a rigid supporting surface, said pan being generally C-shaped with a closed end portion secured to a rear surface of said lug shroud portion of said molded case and with first and second legs of said C-shaped pan, attached to said rigid supporting surface;

first and second rigid support brackets respectively, rigidly attached to said first and second legs of said C-shaped pan and extending along respective first and second opposite outer side walls of said lug shroud portion of said molded case, said first and second rigid support brackets being configured to resist outward movement of said side walls, the first and second rigid support brackets being further configured to transmit forces exerted on said first and second brackets by said side walls, to said respective first and second legs of said C-shaped pan, placing in tension said closed end portion of said C-shaped pan; and said closed end portion of said C-shaped pan being further configured to resist outward movement of said rear surface of said lug shroud portion of said molded case, when said closed end portion of said C-shaped pan is placed in said tension.

6. The molded case circuit breaker of claim 5 in which each of said support brackets includes side flanges that engage the pan legs to which that bracket is attached.

7. The molded case circuit breaker of claim 6 in which said side flanges extend along a pair of opposite exterior side walls of said molded case adjacent said lugs to resist outward movement of said side walls in the event of a short circuit condition.

8. The molded case circuit breaker installation of claim 5 which includes an electrical insulator between said pan and said bottom wall of said lug shroud, and between each of said support brackets and the adjacent surface of one of said opposite sides of said molded case.

9. The molded case circuit breaker installation of claim 5 in which each of said support brackets forms a channel so that the bracket is rigid.

* * * * *